United States Patent [19]

Goldenberg et al.

[11] Patent Number: 4,586,662

[45] Date of Patent: May 6, 1986

[54] FLEXIBLE SPOKE ROTOR FOR MULTIPLE DISK REFINER

[75] Inventors: Philip H. Goldenberg, Pittsfield; George J. Neuf, Dalton; Edward C. Kirchner, Pittsfield, all of Mass.

[73] Assignee: Beloit Corporation, Beloit, Wis.

[21] Appl. No.: 669,540

[22] Filed: Nov. 8, 1984

[51] Int. Cl.[4] ..... B02C 19/00

[52] U.S. Cl. ..... 241/102; 241/261.3; 241/296; 241/297

[58] Field of Search ..... 241/261.2, 261.3, 251, 241/DIG. 30, 102, 296, 297, 298, 163

[56] References Cited

U.S. PATENT DOCUMENTS

| | | | |
|---|---|---|---|
| 360,670 | 4/1887 | Etnier, Jr. | 241/DIG. 30 X |
| 1,995,549 | 3/1935 | Myers | 241/296 X |
| 2,567,448 | 9/1951 | Rickerich, Jr. et al. | 241/296 |

FOREIGN PATENT DOCUMENTS

| | | | |
|---|---|---|---|
| 527395 | 7/1956 | Canada | 241/163 |

*Primary Examiner*—Howard N. Goldberg
*Assistant Examiner*—Timothy V. Eley
*Attorney, Agent, or Firm*—Hill, Van Santen, Steadman & Simpson

[57] ABSTRACT

A multi-disk refiner utilizing a plurality of spaced rotor disks which rotate in a housing in spaced relation to a plurality of spaced stator disks, the confronting disks having ribs thereon which abrade a stock suspension passing in the space between the rotor and stator disks. In accordance with the present invention, there is provided a plurality of flexible rotors which have spokes extending therefrom, the spokes being received in slots in loosely fitting relation so as to permit relative sliding movement between the spokes and the rotor disks while transmitting torque. A resilient bumper is provided on each of the spokes to provide a pivot point within the slot such that axial movement of the rotor disks provides a simple bending load to each spoke thereby defining a soft, linear spring system.

15 Claims, 5 Drawing Figures

FLEXIBLE SPOKE ROTOR FOR MULTIPLE DISK REFINER

BACKGROUND OF THE INVENTION

1. Field of the Invention

The present invention is directed to a multi-disk refiner wherein a large number of refiner disks are mounted inside a refiner to provide for a very low intensity treatment of suspensions such as stock suspensions for the manufacture of paper. The invention provides a method of exerting rotational force to the refining disks while at the same time permitting them to move in the axial direction as load is applied.

2. Description of the Prior Art

Paper stock, as it comes from beaters, digesters, or other pulping machines is usually refined by passing the stock between grinding or refining surfaces which break up the fibrous materials and serve to create further separation and physical modification of the fibers.

A typical pulp refiner is disclosed in Thomas U.S. Pat. No. 3,371,873. This type of refiner includes a rotating disk which has annular refining surfaces on one or both sides. The disk refining surfaces are in confronting relation with non-rotating annular grinding surfaces and provide therebetween a refining zone in which the pulp is worked. The rotating disk and the refining surfaces are made of a substantially inflexible material such as cast iron or a hard stainless steel. The non-rotating grinding surfaces are made of similar material and are rigidly mounted so as to resist the torque created by the rapidly rotating disk and the pressure on the pulp material passing through the refining zone gap. Axial adjustment of the refining zone gaps is effected by axial shifting of the shaft on which the disk is mounted.

Rigid disk refiners of this type must be manufactured and assembled to close tolerances in order to set the refining zone gap width correctly. Because the loads applied to the rigid disk are large during the refining process, a large and extremely rugged design is necessary so that the refining surface relationships do not change under load. This results in the rigid disk refiners being very costly due to the necessarily close tolerance machining, the need for large quantities of high-strength disk material, the bulky overall structure, the restrictive machine capacity, and the excessive assembly time requirements.

Substantial improvements in pulp refiners have recently been accomplished with the advent of the multi-disk refiner which operates at a low intensity. For example, in Matthew and Kirchner pending U.S. Ser. No. 486,006 entitled "Flexible Disk Refiner and Method", assigned to the same assignee as the present application, there is provided a refining apparatus including a plurality of radially extending, relatively rotatable and axially confronting refining surfaces between which the suspension must pass while being refined during relative rotation of the surfaces. Means are provided for effecting flow of the material radially between and across the surfaces. The particular improvement of that application comprises using resiliently flexible refining surface supporting means which permit adjustment of the relatively rotating refining surfaces axially relative to each other depending upon the operating pressures, thereby attaining optimum material working results from the refining surfaces.

In a specific embodiment disclosed in the aforementioned application, there is provided a pulp refiner with ring-shaped refining surface plates of limited radial width which are mounted on interleaved margins of axially resiliently flexible or deflectable disk elements. Disk margins spaced from the interleaved margins on one set of the disk elements are secured to a rotor while the margins on another set of disks are secured non-rotatably or counter-rotatably. The refining surface plates are made of a suitably hard, substantially rigid material. The disk elements, on the other hand, are made of axially resilient flexible material which strongly resists deformation in the circumferential direction. Because of the manner in which the axially flexible disk elements are supported, there is an automatic axial self-adjustment of the refining surfaces during the pulp-refining process for attaining optimum refining action by the relatively rotating refining surfaces.

The multi-disk refiner has made a substantial improvement in the art of refining. It has been shown that with the use of a low-intensity, multi-disk refiner, pulp characteristics can be improved considerably over conventional refining techniques. Originally, such refiners were built using flexible diaphragms to restrain the refining disks and provide the torsional rigidity and torsional strength required to transmit rotational forces into the refining surfaces. The resiliency of the diaphragms permitted sufficient axial motion of the refiner disks such as required as each surface moves into close proximity to its adjacent neighbors as the refiner is loaded to its operational position.

It was found, however, that once a significant amount of wear occurred in the refining surface an additional amount of load was required to keep the surfaces within close proximity which reduced the ability of the refiner to provide low intensity refining. Since the deflection occurring in a diaphragm is proportional to the cube of the load, it was determined that such a support was not optimum for a system subject to the amount of wear occurring in a commercial installation.

SUMMARY OF THE INVENTION

The present invention was designed to meet the requirements imposed by a new refining concept using multi-disk refiners whereby a large number of refiner disks are mounted inside the refiner to provide for very low intensity treatment of the paper pulp. The present invention provides a means of exerting rotational force to the refining disks while at the same time allowing them to move in the axial direction as load is applied. The drive system of the present invention provides a low axial spring constant, high torsional rigidity and strength, and an ability to permit the refining surfaces to remain parallel under load.

In the present invention, we provide a multi-disk refiner which includes a housing, a rotatable hub mounted for rotation within the housing, a plurality of spaced refiner rotor disks concentric with the rotatable hub, and a plurality of spaced stator disks positioned in the housing in opposed relation to the refiner rotor disks, thereby providing passages between confronting refiner rotor disks and stator disks through which a suspension to be refined can be passed. A plurality of flexible rotors is secured to the hub and each has spokes extending into slot means existing between a pair of rotor disks while permitting relative sliding movement between the spokes and the rotor disks. A resilient bumper is provided on each of the spokes to provide a pivot point such that the axial movement of the rotor disks provides a simple rather than a compound bending load to each spoke.

In a preferred form of the present invention, each of the bumpers is slightly compressed against the top and bottom surfaces of the slot means to provide some degree of frictional engagement with the walls of the slot as the spokes move. The bumpers preferably consist of resilient O-rings, while the rotors are composed of a strong material such as a fiberglass composite or a spring steel.

A structurally preferred form of the invention makes use of a spacer which is secured between each pair of refiner rotor disks, the spacer having a thickness greater than the thickness of a spoke and providing a slot between the disks which provides a substantial clearance about the spoke other than at the site at which the bumper is clamped between the walls of the slot.

The present invention also provides an improved subassembly for use in a multi-disk refiner including a pair of refiner disks in back-to-back relation, each refiner disk having ribs thereon for abrading a stock suspension in contact therewith. Means are provided to establish spaced slots between the pair of refiner disks. A flexible rotor having spokes therein of lesser dimensions than the slots cooperate with the refiner disks so as to be slidable in the slots with the resilient bumper on each of the spokes frictionally engaging the walls of the slots to provide a pivot point for each spoke.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
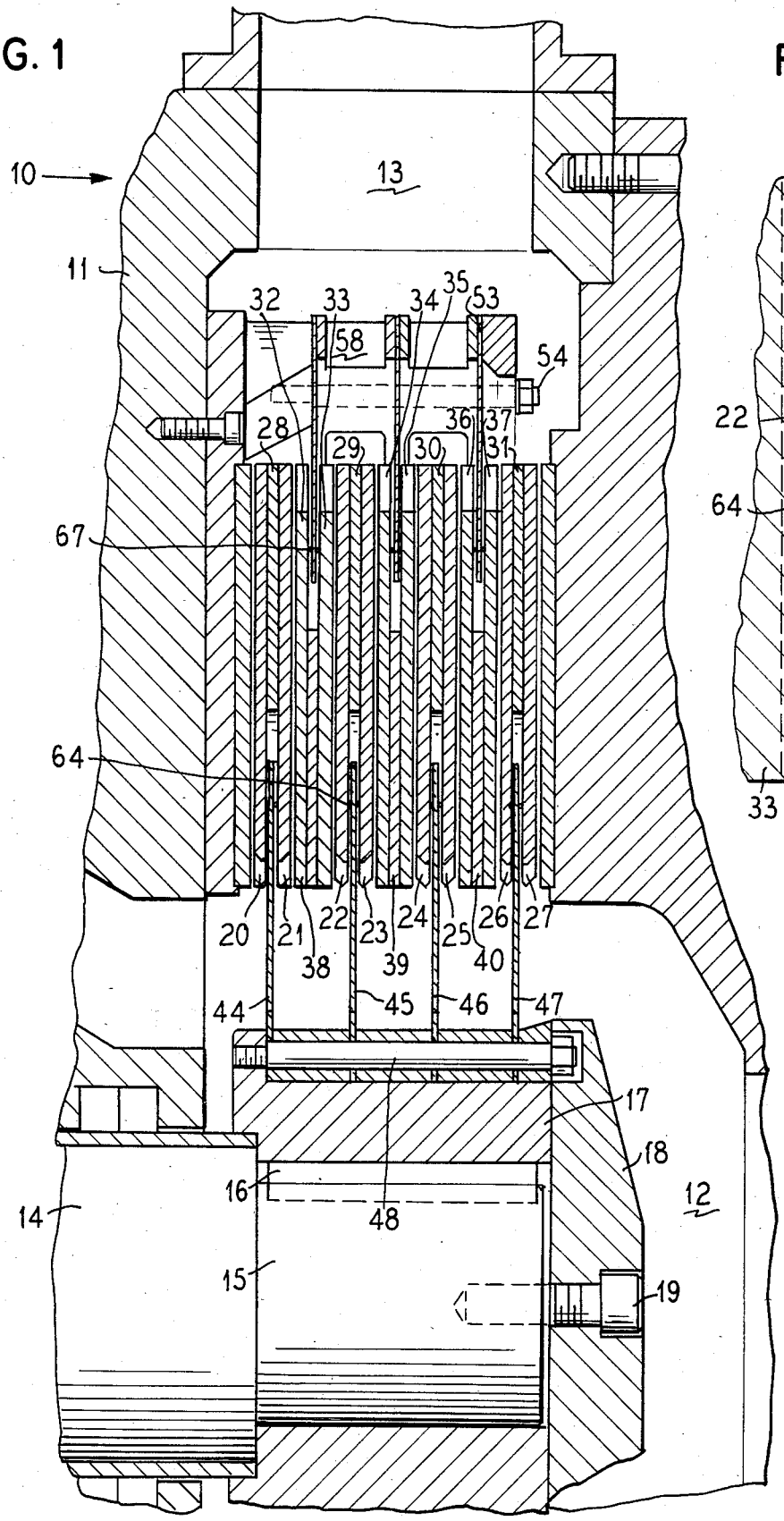
FIG. 1 is a fragmentary cross-sectional view of a multi-disk refiner embodying the principles of the present invention.

In FIG. 1, reference numeral 10 indicates generally a multi-disk refiner including a housing 11 having an inlet 12 for receiving a stock suspension to be processed. After passing through the spaces between cooperating rotor and stator disks which will be described more completely hereinafter, the treated stock suspension exits the housing through a discharge outlet 13.

A shaft 14 is mounted for rotation within the housing by means of a motor (not shown) and carries a stub shaft 15 which is keyed by means of a key 16 to a rotor 17. A cover plate 18 is secured to the stub shaft 15 by means of bolts 19.

In passing between the inlet 12 and the outlet 13, the stock suspension must pass between interleaved rotor and stator refiner disks which reduce and fibrillate the fibrous materials in the suspension into smaller, discrete fibers. The rotor disks are arranged in pairs such as the pairs 20 and 21; 22 and 23; 24 and 25; and 26 and 27 best shown in FIG. 1. The pairs of rotor disks are separated by spacers identified at reference numerals 28, 29, 30 and 31, respectively.

Interleaved with the pairs of rotor disks are a plurality of pairs of stator disks 32 through 37, respectively. The stator disks are separated by spacers 38, 39 and 40.

Figure 2:
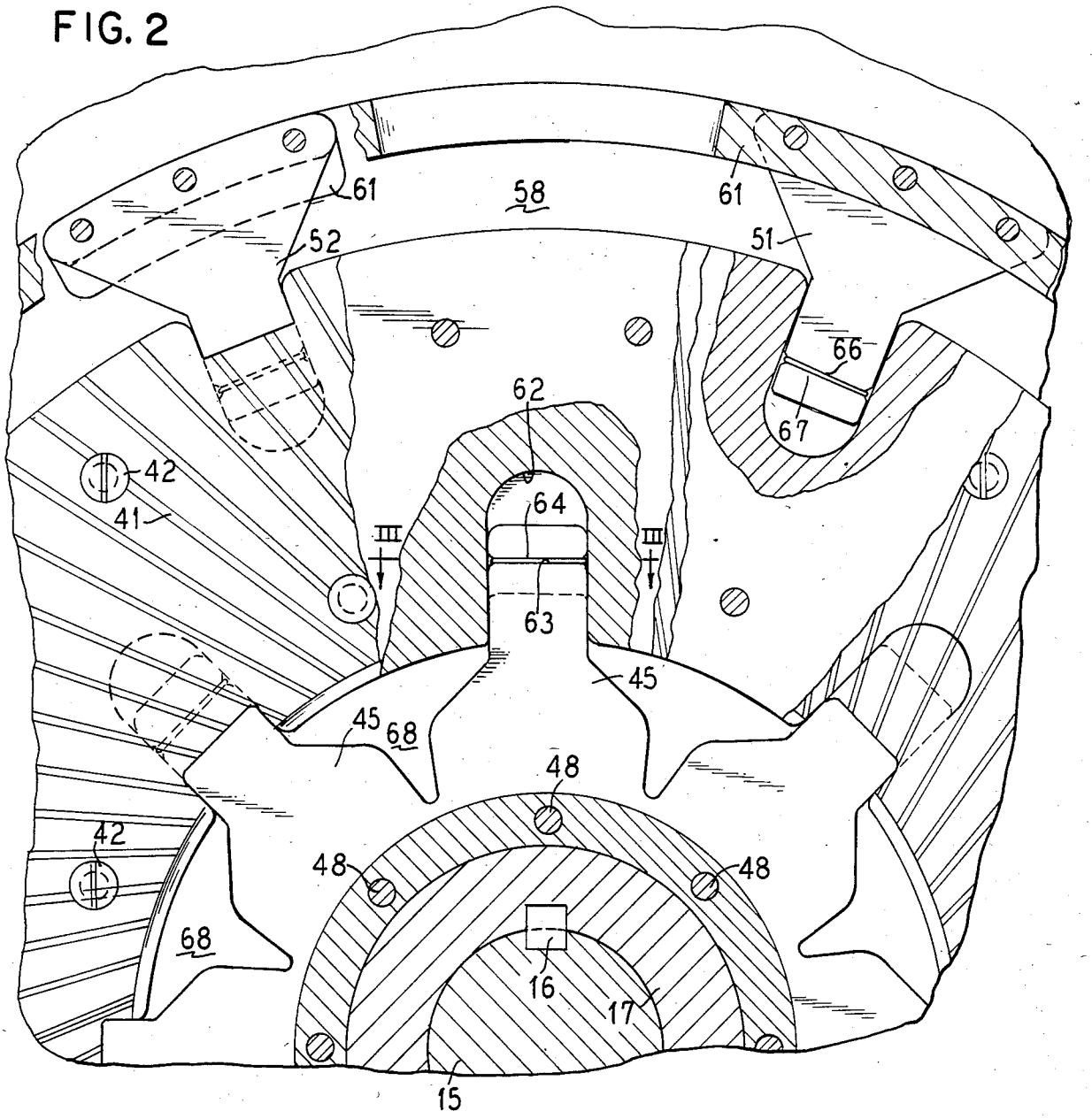
FIG. 2 is a view partially in elevation and partially in cross-section illustrating the manner in which the spokes are received in relation to the rotor structures, with portions thereof being broken away to better illustrate the construction.

The confronting rotor and stator disks are provided with annularly extending ribs 41, some of which are shown in FIG. 2. These ribs act upon the stock suspension passing between the opposed rotor and stator refiner disks to cause attrition or abrasion of the fibers, resulting in breaking up any fiber clumps present and generally enhancing fiber development by breaking the cell walls and increasing the surface area of the fiber.

The pairs of rotor disks such as the disks 22 and 23 are separated by a spacer such as spacer 29 and the disks are mechanically secured to the spacer by means of fastening means such as screws 42 (FIG. 2).

A driving connection, yieldable in the axial dimension, is provided by a plurality of flexible rotors 44, 45, 46 and 47. These rotors are suitably apertured at their inner ends so they can be clamped to the rotor 17 by means of bolts 48.

The stator refiner disks are also positioned in pairs such as pairs 32 and 33; 34 and 35; and 36 and 37. Their axial deflectability is provided by including flexible fingers 51, 52 and 53, respectively, between the pairs. A plurality of bolts 54 clamp together the successive stator disks together with their spacers while leaving passageways 58 permitting the suspension to flow from the working area into the discharge 13. The fingers 51, 52 and 53 may be fixedly secured to the housing by a suitable support structure 61.

Figure 5:
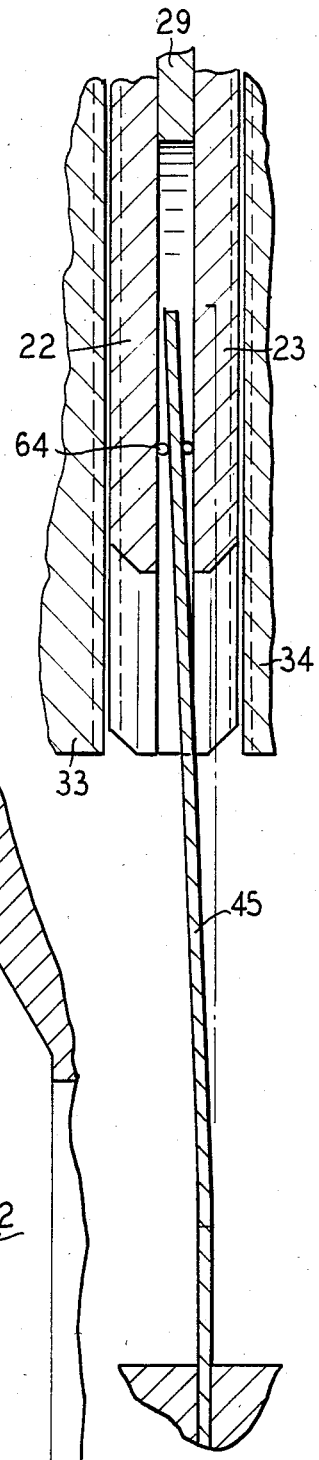
FIG. 5 is a fragmentary cross-sectional view illustrating the manner in which the flexible rotors bend to provide axial flexibility while providing torsional rigidity and strength.
Figure 3:
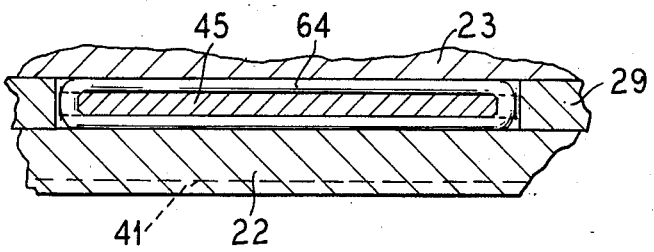
FIG. 3 is an enlarged cross-sectional view taken substantially along the line III—III.

The rotors 44, 45, 46 and 47, as well as the fingers 51, 52 and 53, are constructed from very thin membranes of materials such as high strength fiberglass composites (glass filaments in a matrix of polyester or epoxy resin) or they may be composed of spring steel or any other suitable material. Each spoke on the rotor is loosely received in a slot 62 as best illustrated in FIG. 2 of the drawings. Near the distal end of each spoke there is provided a transverse groove such as groove 63 illustrated in FIG. 2 which provides a seat for a resilient bumper such as an O-ring 64. As best seen in FIG. 3, the rotor spokes themselves are loosely received within the slot provided by the presence of the spacer 29, but the O-ring 64 is slightly compressed against the top and bottom surfaces of the slot but it still may slide along the slot's length to provide for the necessary movement of the spoke as it is translated along the axis of the shaft. The resilient bumper provided by the O-ring 64 provides a pivot point within the slot so that the axial movement of the refiner disk imparts a simple bending load to each spoke as illustrated in FIG. 5. In contrast, if the spoke were clamped rigidly at both ends, there would be a compound bending with a substantially different spring characteristic. The provision of the pivot point within the slot also allows the refining surfaces of the refiners to rotate into a parallel position with the other refining surfaces.

Likewise, the fingers 51 to 53 are provided with transverse grooves such as groove 66 near the end of the finger to accommodate a flexible O-ring 67 as best illustrated in FIG. 2.

The torsional load required to be carried by the rotor is translated into a side-bearing load on each spoke within the refiner disk slots. The wide flat shape of the spokes provides the necessary stiffness to carry this load. The torque is carried as a shear loading in the rotor and does not have any apparent significant effect on the axial bending performance.

As best seen in FIG. 2, substantial areas 68 are provided between the spokes to allow the flow of the paper stock to enter the refining cavity and be distributed between each pair of refining surfaces.

Figure 4:
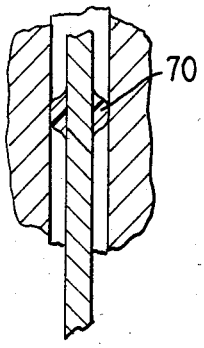
FIG. 4 is a fragmentary view illustrating a modified form of the invention.

In the alternative form shown in FIG. 4, instead of employing an O-ring as the resilient bumper, the spoke may be provided with a continuous bead 70 of an elastomeric resin such as a polysilicone elastomer.

The resilient bumpers which are fixed to the ends of the spoke act as pivot points about which the refining surfaces can rotate, with regard to the plane of the membrane to maintain them parallel with the adjacent surfaces. The bumpers are slightly compressed against the top and bottom surfaces of the slots, thus centering the rotor within the slot.

The slots are constructed in such a way as to provide for a light clamping of the spoke bumper so a considerable clearance around the balance of the spoke exists and the spoke is allowed to deflect without interference from the top or bottom surfaces of the slot. Consequently, the spoke exhibits a simple bending and its deflection is directly proportional to the applied load. The width of the slot in the plane of the rotor matches closely with the spoke width so that the side-bearing load applied as a function of the torque is equally distributed into each spoke.

The present invention thus involves the provision of a flexible spoked rotor attached to a refiner disk in such a way as to provide torsional rigidity with axial flexibility. This allows the disk to move axially along the axis of the refiner shaft aligning itself with the other refining surfaces. Each spoke of the rotor is sandwiched between the refining surfaces in such a way as to provide for the necessary lengthening of the spoke as the disk moves axially along the shaft.

The present invention provides an improvement in the multi-disk refiner which operates at low intensity. The invention provides a means for exerting rotational force to the refining disk while at the same time allowing the disk to move in the axial direction as load is applied. The improved spoked rotors of the present invention provide a low-spring constant, a high-torsional rigidity, and have the ability to allow the refining surfaces to remain parallel.

It should be evident that various modifications can be made to the described embodiments without departing from the scope of the present invention.

We claim as our invention:

1. A subassembly for use in a multi-disk refiner comprising:

a pair of refiner disks in back-to-back relation, each refiner disk having ribs thereon for abrading a stock suspension in contact therewith, means defining spaced slots between said pair of refiner disks, a flexible rotor having spokes of lesser dimensions than said slots so as to be freely slidable therein, and a resilient bumper on each of said spokes frictionally engaging the walls of said slots to provide a pivot for each spoke.

2. A subassembly according to claim 1 which includes:

a spacer confined between said pair of refiner disks and secured thereto, said spacer providing said spaced slots.

3. A subassembly according to claim 1 wherein:

said resilient bumper is in the form of a resilient O-ring.

4. A subassembly according to claim 3 wherein said spoke has a transverse notch therein in which said O-ring is received.

5. A subassembly according to claim 1 in which:

said resilient bumper is in the form of a bead of an elastomeric resin.

6. A multi-disk refiner comprising:

a housing, a rotatable hub mounted for rotation within said housing, a plurality of spaced refiner rotor disks concentric with said rotatable hub, a plurality of spaced stator disks located in said housing in opposed relation to said refiner rotor disks, thereby providing passages between confronting refiner rotor disks and stator disks through which a suspension to be refined can be passed, said disks including ribs extending into said passages for abrading a stock suspension in contact therewith, a plurality of flexible rotors secured to said hub and having spokes extending between said rotor disks in loosely fitting relation permitting relative sliding movement between said spokes and said rotor disks and a resilient bumper on each of said spoked providing a pivot point such that axial movement of said rotor disks provides a simple bending load to each spoke.

7. A refiner according to claim 6 which includes:

slot means between a pair of rotor disks receiving said spokes in said loosely fitting relation to permit relative sliding movement.

8. A refiner according to claim 7 wherein:

each of said bumpers is slightly compressed against the top and bottom surfaces of said slot means.

9. A refiner according to claim 8 wherein said bumpers consist of resilient O-rings.

10. A refiner according to claim 8 wherein said bumpers consist of beads of an elastomeric resin.

11. A refiner according to claim 6 wherein said rotors are composed of a fiberglass composite.

12. A refiner according to claim 6 wherein said rotors are composed of a spring steel.

13. A refiner according to claim 6 wherein said refiner rotor disks are in pairs, a spacer secured between each disk constituting a pair, said spacer having a thickness greater than the thickness of a spoke, thereby providing a slot for lightly clamping of a bumper on one of said spokes.

14. A refiner according to claim 6 wherein:

said slot provides a substantial clearance about said spoke other than at the clamping site.

15. A refiner according to claim 6 which includes:

means between said spokes defining fluid passage areas directing the flow of said suspension into said passages.

* * * * *

UNITED STATES PATENT AND TRADEMARK OFFICE

CERTIFICATE OF CORRECTION

PATENT NO. : 4,586,662

DATED : May 6, 1986

INVENTOR(S) : Phillip H. Goldenberg, George J. Neuf, & Edward C. Kirchner

It is certified that error appears in the above-identified patent and that said Letters Patent are hereby corrected as shown below:

Column 6, Claim 6, Line 36: Change "spoked" to "spokes"

Signed and Sealed this

*Nineteenth* Day of *August 1986*

[SEAL]

*Attest:*

DONALD J. QUIGG

*Attesting Officer*

*Commissioner of Patents and Trademarks*